United States Patent [19]

Smith

[11] 3,998,334

[45] Dec. 21, 1976

[54] FLEXIBLE MERCHANDISE DISPLAY RACK

[76] Inventor: Lloyd D. Smith, 6621 Lautrec Place, Rancho Palos Verdes, Calif. 90274

[22] Filed: Oct. 28, 1975

[21] Appl. No.: 626,190

[52] U.S. Cl. ..... 211/45; 211/70; 211/163; 312/135

[51] Int. Cl.[2] ..... A97F 7/16

[58] Field of Search ..... 211/45–48, 211/56, 58, 60–69.1, 70, 77, 78, 86, 95, 129, 131, 144, 163, 166; 312/125, 135, 197; 248/131, 415, 425; D6/188; 108/94, 95

[56] References Cited

UNITED STATES PATENTS

| | | | |
|---|---|---|---|
| 112,277 | 2/1871 | Phillips | 312/135 |
| 528,885 | 11/1894 | Lindsey | 312/135 |
| 1,628,128 | 5/1927 | Dunn | 211/58 |
| 3,003,648 | 10/1961 | La Vigne | 211/144 |
| 3,635,352 | 1/1972 | Brooks et al. | 211/47 |
| D206,201 | 11/1966 | Kingsford et al. | D6/188 |

FOREIGN PATENTS OR APPLICATIONS

| | | | |
|---|---|---|---|
| 1,166,929 | 11/1958 | France | 211/63 |
| 19,503 | 8/1909 | United Kingdom | 108/95 |

*Primary Examiner*—Ramon S. Britts
*Assistant Examiner*—Terrell P. Lewis
*Attorney, Agent, or Firm*—Singer & Singer

[57] ABSTRACT

An improved flexible merchandise display rack capable of displaying a plurality of similar sized swatches of materials such as carpet samples. A plurality of individual assemblies are each pivotably mounted on a vertical shaft. Each assembly consists of a pair of spaced-apart disc members separated by posts connected to opposite sides of opposing discs along the periphery thereof. The space between opposing discs is a function of the width of the individual samples that are inserted about one or two or even three of the posts with the end portion of the samples towards the central shaft. A plurality of the assemblies may be stacked one above the other on a single shaft thereby allowing a greater number of samples to be displayed in a given area than has heretofore been possible to achieve. In addition, the individual samples are all supported within each assembly thereby obviating the need for the customer to hold or otherwise support any of the samples. Rotating each of the assemblies provides a complete display of all samples for the customer's consideration.

14 Claims, 5 Drawing Figures

FLEXIBLE MERCHANDISE DISPLAY RACK

This invention relates to an improved flexible merchandise display rack for use in a showroom where it is highly desirous for the vendor to present the customer with a wide variety of samples in a given location and without the necessity of the customer having to lift or physically move samples from or above one from the other in order to observe the characteristic of each of the samples.

The term flexible merchandise is intended to cover those goods usually sold by way of sample and in which the vendor supplies a swatch of given quantity of the goods in question for the customer's consideration. Goods of this nature usually include rug swatches or samples, wallpaper samples, linoleum and floor covering samples, and other flexible materials intended to cover either the walls or floor portions of a dwellinghouse.

In the art of selling rugs, for example, the manufacturer makes available to the vendor swatches of the complete line of rugs available in his inventory. The vendor actually purchases the samples prepared by the manufacturer, which samples are all cut to the same size for display purposes.

The problem of the vendor is to properly display all the samples in a manner that is convenient for the customer so that the samples may be viewed one against the other with a minimum of discomfort to the customer and a minimum of handling of the individual samples. At the same time it is necessary to provide a means for quickly comparing and retrieving samples in order that the customer may continually review the samples while at the same time compare a previous sample against a new showing.

The prior art is predominantly concerned with mounting the individual samples of a given manufacturer in booklet form according to some arbitrary criteria such as quality, price or color. The number of swatches in any given booklet is limited by weight considerations since more than approximately six swatches becomes increasingly difficult for the customer to hold and manipulate when reviewing the different samples.

Different showroom techniques include placing a booklet on the table wherein the customer is then asked to flip the swatches as one would flip the pages of a large book, thereby viewing each of the swatches sequentially. The vendor then attempts to remove the old book while bringing new books for the customer's consideration. Admittedly the procedure is timeconsuming since the vendor must be with the customer at all times and, further, the total number of swatches capable of being viewed is extremely limited by the number of books and the weight of the books available. The procedure is limited as a selling tool since the number of swatches that can be conveniently brought to the attention of the customer in a given period of time is limited as is the recall of continually comparing past swatches with new swatches.

Certain improvements have been made in the display of the books of swatches which include hanging the individual books from vertical racks that appear to be outsized tree hangers. The tree hangers are outsized in view of the size of the books and the fact that each book is hung from a hook a substantial distance from the centermost portion of the hanger tree in order to allow the hanging of a plurality of books. The procedure does allow at least four books to be hung about a hanger tree and approximately three of four books to be hanged vertically. The customer is then caused to lift each swatch sequentially in order to view the swatch being displayed and the swatch underneath. The process is then repeated for each book and for each swatch contained in the book.

The advantages claimed for the hanger tree method of displaying books of swatches is that the customer no longer needs to hold each book nor does the salesperson have to accompany the customer while the customer proceeds to leaf through the individual books and the individual swatches contained in each book.

A more recent and highly innovative technique for displaying individual swatches consisted of a rotary drum horizontally disposed with a plurality of individual swatches individually connected to the periphery of the drum so that rotating the drum sequentially displays one swatch at a time for the consideration of the customer.

The drum did eliminate the need for the customer holding the individual swatch and also provided a quick display of a larger number of swatches for the consideration of the customer. Unfortunately the drum containing all the swatches attached thereto is cumbersome and difficult to rotate and does in fact require the assistance of the vendor in order to help the customer review the merchandise.

The present invention is concerned primarily with a flexible merchandise display rack that eliminates all of the disadvantages mentioned above with respect to the prior art devices and does in fact provide a means in which the individual customer may review a larger number of swatches in a smaller space and in such a manner that is convenient, simple, and provides total recall of any given swatch previously seen. In addition, the individual swatches are not fixedly attached to the display means thereby allowing the customer the option of removing any given swatch from the display means to thereby compare, handle, or otherwise view the swatch in question.

In the present invention there is disclosed a shaft acting as an axle for holding a pair of spaced-apart discs each rotatably attached to the shaft. A plurality of posts are equally spaced between said discs and each of said posts have end portions that are fixedly attached to corresponding portions along the periphery of the discs.

The complete assembly comprising the discs and the attaching posts are therefore rotatable about the shaft. The individual shaft is preferably mounted in a vertical position and may be secured to a floor mount only or the shaft may be mounted and secured by mountings on the bottom and the top of the shaft. In the preferred embodiment the spacing between opposing discs is the same as the width of the swatch samples of the merchandise being displayed.

The individual swatches or rug samples are inserted preferably about one, two or three of the posts with the end portions of the swatch towards the central shaft member. Using an assembly having 24 posts separating the opposing disc members, it is possible to display 24 samples by having each sample encompass only a single post. A variable number of swatch samples may be displayed. For example, 12 samples may be displayed by having each swatch encompass two posts, or a lesser number of samples may be displayed by having each sample encompass additional posts.

The preferred embodiment provides for at least five assemblies stacked one upon the other on a given shaft. Since each assembly may hold up to 24 samples, it is possible therefore for the five tier assembly to display a total of 120 swatch samples in an extremely small area. The customer need only independently rotate each assembly until some desired quality and color sample is selected for comparison purposes. The customer may simply remove the sample from the assembly by physically pulling the swatch sample from the enclosure since there is nothing physically holding the sample within the display device. Each of the five assemblies are independently rotatable one about the other on a single shaft and hence the customer has at his option the convenience of reviewing at least 120 rug samples in a given location without physically handling or holding or flipping swatch samples as is so prevalent with the prior art devices.

Further objects and advantages of the present invention will be made more apparent by referring now to the accompanying drawing wherein.

Figure 1:
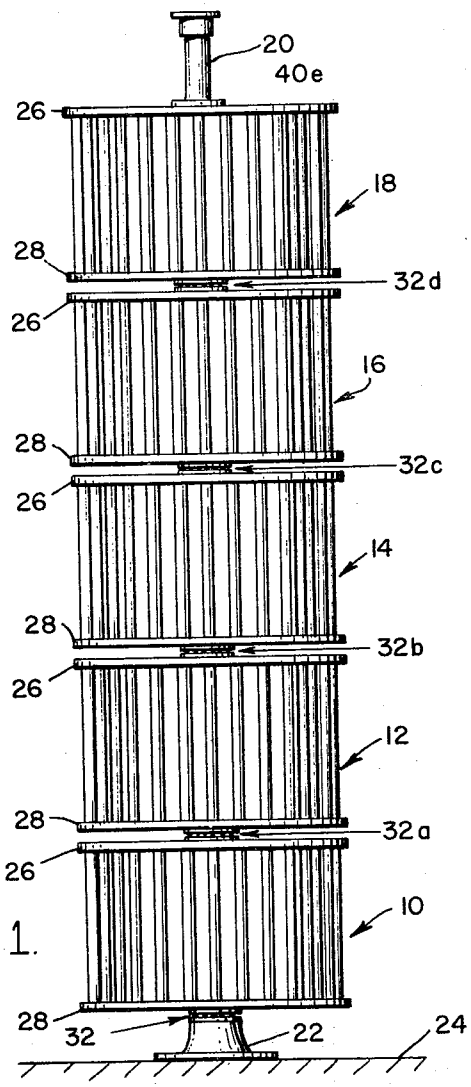
FIG. 1 illustrates a plan view of a plurality of assemblies mounted on a single shaft.

Referring now to FIG. 1 there is shown a plurality of identical assemblies 10, 12, 14, 16 and 18, all adapted to be supported one above the other and in which each assembly is rotatable about shaft 20.

Shaft 20 is fixedly attached at one end to a pedestal 22 that is fixedly attached to the ground portion 24. In the preferred embodiment the shaft 20 is intended to be mounted to the floor portion as at 24 and to a ceiling or overhead member not illustrated. FIG. 1, however, shows an alternative procedure for setting shaft 20 in a weighted base assembly 22 which thereby allows the complete assembly comprising the shaft 20 and the individual assemblies 10, 12, 14, 16 and 18 to be positioned on the floor and moved about as determined only by the dictates of the vendor selling his wares.

The individual assemblies are all identical and comprise a pair of spaced-apart disc members 26 and 28 connected to each other by means of a plurality of posts 29 fixedly attached to corresponding portions along the periphery of said discs 26 and 28. The discs 26 and 28 are preferably solid, of sufficient strength and thickness to hold the weight of at least 24 swatch samples of carpet.

The centralmost portion of each of the discs 26 and 28 contain an opening 30 that is slightly larger than the diameter of the post 20.

The stacking of assemblies 10 through 18 on the shaft 20 may be accomplished alternatively in one of two ways. In one embodiment each assembly 10 through 18 is stacked one upon the other and separated by bearing assemblies 32 which in effect act as thrust bearings in which each assembly supports the weight of the bearing and assembly upon it.

For example, FIG. 1 illustrates thrust bearing 32 in contact with the pedestal support mount 22. Assembly 10 is placed over shaft 20 and rests upon bearing 32. A similar bearing **32*a* is placed over shaft 20 and rests upon disc 26. Similarly assembly 12 is placed over shaft 20 and rests upon bearing 32*a* and in a similar fashion bearing 32*b*, assembly 14, additional bearing 32*c*, assembly 16, and an additional bearing 32*d* with final assembly 18 placed sequentially over shaft 20** to thereby complete the display rack.

It will be apparent that bearing 32 in contact with the pedestal support 22 supports the weight of each of the assemblies 10, 12, 14, 16 and 18. In a similar fashion assembly 12 supports the weight of assemblies 14, 16 and 18, and in a similar fashion assembly 14 supports the weight of assemblies 16 and 18 mounted above.

The individual bearing assemblies **32*a*, 32*b*, 32*c* and 32*d* separating each of the assemblies 10, 12, 14, 16 and 18** allow each of the assemblies in turn to be rotated independently of the assembly either above or below, thereby providing complete freedom for the assembly to rotate without affecting the assembly either above or below.

The normal mode of operation is to turn very slowly under the influence of the user. It is not the intention of the display rack to provide a high speed rotatable drum assembly since in normal operation each drum assembly 10 through 18 is slowly moved and not allowed to freely rotate since that would obviate the purpose of the rack which is to sequentially provide a display of each swatch of material located on each drum.

Figure 2:
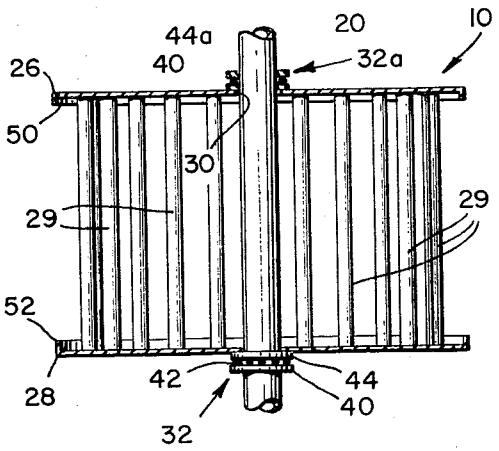
FIG. 2 is a cross-sectional view of a single assembly illustrating the internal configuration.

Referring now to FIG. 2 there is shown a cross-section of assembly 10 which more fully illustrates how the assembly is mounted on the shaft 20.

The bearing assembly 32 is comprised of a lower race 40, captive bearings 42, and an upper race 44. The diameter of both the lower race 40 and the upper race 44 are greater than the diameter of the shaft 20. In the preferred embodiment race 44 is physically attached by tacking to disc 28 and race 40 is physically attached to pedestal 22. The captive bearing assembly 42 is actually a self-contained bearing assembly that is distinct and separate from either of the races 40 or 44 and is separately inserted as a unit between race 40 and 44. Similarly, race **40*a* of bearing 32*a* is tacked to disc 26 while race 44*a* is tacked to disc 28 of assembly 12** located immediately above.

Figure 3:
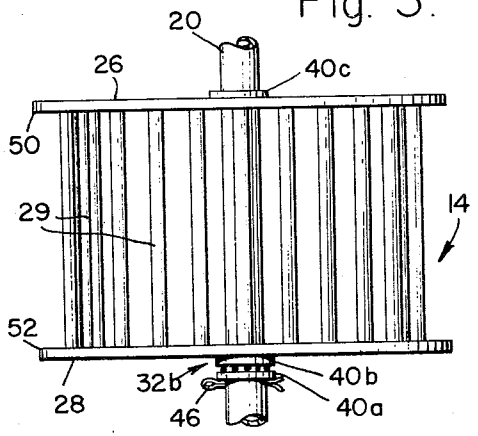
FIG. 3 is a cross-sectional view of a second embodiment.

Referring now to FIG. 3 there is shown a second embodiment for installing a plurality of assemblies 10, 12, 14, 16 and 18 on the shaft 20 in which each of the assemblies are individually pinned in a given location on the shaft thereby allowing each assembly 10 through 18 to be individually supported by the shaft 20 without the lowermost assembly carrying any of the weight of the uppermost assemblies.

If we assume that FIG. 3 illustrates assembly 14 which is the centermost assembly illustrated in FIG. 1, we will observe immediately that bearing assembly **32*b* placed below the assembly 14 contains race 40*b* and race 44*b* which is connected to disc 28.**

Assembly 14 is independently supported on shaft 20 by means of a cotter pin or other locking device 46 that is inserted through a transversely located hole within shaft 20. Race **40*b* is caused to bear against the cotter pin 46 thereby supporting the complete assembly comprising bearing 32*b* and assembly 14.**

Similarly, each assembly above 10, namely 12, 14, 16 and 18, are each separated from every other assembly by means of a suitable cotter pin 46 thereby allowing each assembly to be supported directly by shaft 20 and not to otherwise depend on the assembly below for support.

It will be obvious to those skilled in the art that each assembly 10 through 18 may also have individual ball bearings conventionally mounted on the disc 26 and 28 within opening 30 to facilitate rotation where ease of rotation is to be improved.

A review of FIGS. 2 and 3 will show that the posts 29 are all parallel to each other and inter-connect disc 26 and 28 at corresponding points along the periphery. In the preferred embodiment the circumference portion of the discs 26 and 28 have a shoulder portion 50 and 52 located on discs 26 and 28 respectively. The shoulder portions 50 and 52 are arranged on the discs 26 and 28 so that each shoulder portion for each assembly faces towards each other and thereby provides a recess for holding and trapping the individual swatch material being displayed within the assembly.

Figure 4:
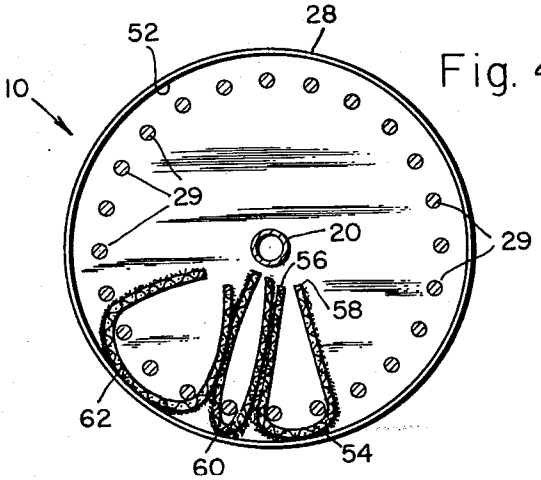
FIG. 4 is a top plan view illustrating how the individual swatch samples are inserted within the assembly.

Referring now to FIG. 4 there is shown a top view of assembly 10 with the uppermost disc portion 26 removed. The individual swatch sample 54 is preferably located about two posts 29 with the end portions 56 and 58 of the swatch facing the shaft 20. In this fashion the assembly 10 having 24 posts is capable of holding 12 swatches 54. It is possible to display more swatches by locating an individual swatch 60 about a single post 29 thereby increasing the capability of assembly 10 to display 24 swatches. Where less swatches are to be displayed, the vendor need only encircle more posts 20 such as swatch 62 which is shown encompassing three posts 20 thereby reducing the capacity of the assembly 10 to display only eight swatches.

The advantage to the vendor is that he can place as few or as many swatches in his display rack without causing the mechanism of the display device to interfere with the customer's viewing of the merchandise that he is seeking to vend. The customer need then only rotate the individual assembly in order to view the complete line of colors and quality being offered for his consideration.

Figure 5:
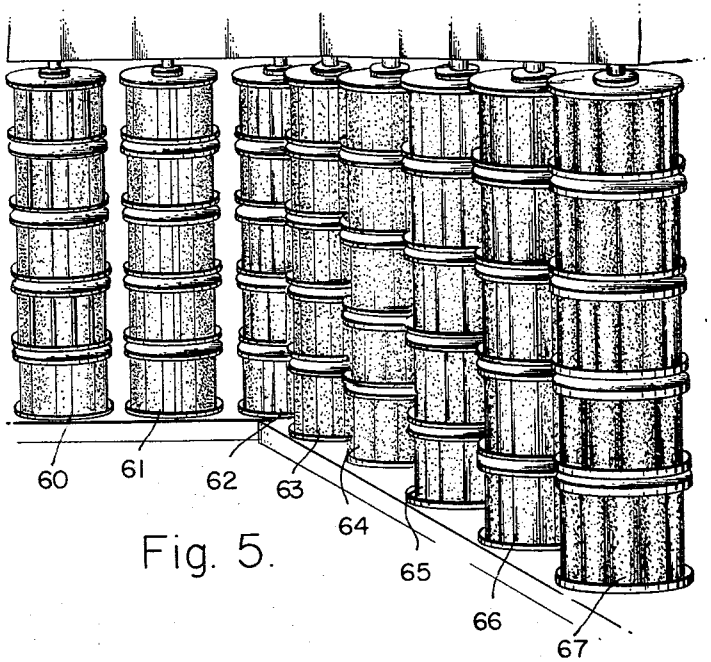
FIG. 5 is a perspective view illustrating how a plurality of display devices similar to FIG. 1 can be used to illustrate a complete line of samples.

Referring now to FIG. 5 there is shown an example of how a small corner of a display room may be constructed using a plurality of eight identical display racks 60 through 67 of the type illustrated in FIG. 1.

Each display rack having five assemblies is capable of displaying 120 swatch samples for the customer's consideration. The corner display illustrated in FIG. 5 shows the display racks having a capacity to display a total of 960 swatch samples for the customer's consideration. The customer need only rotate the individual assembly one at a time for him to see an immediate display of every sample, color and quality for his consideration. The need to hold and physically lift individual samples as disclosed by the prior art is now completely obviated.

The advantages to the vendor in having the customer able to view a complete assembly of swatch samples in a small area and in a short period of time allows the display rack to be a very strong and powerful selling tool. In addition, the ease of inserting and removing a given sample for consideration and recall without having to lift, push or disconnect fixedly attached samples as is necessary in the prior art devices, allows the customer the privilege of reviewing merchandise without the need of an ever-present salesman.

What I claim is:

1. A merchandise display rack for displaying the front side of a swatch of flexible material comprising:

a shaft, a pair of spaced-apart discs each rotatably positioned on said shaft, a shoulder portion located on the periphery of each disc positioned to face each other, a plurality of posts equally spaced between said discs, each of said posts having end portions fixedly attached to corresponding portions near the periphery of said discs whereby said assembly comprising the discs and attaching posts are rotatable about said shaft, and a swatch of flexible material having end portions folded about at least one of said posts and inserted towards said shaft for displaying the front side of the swatch, said swatch having a width that is less than the distance between said spaced-apart discs but greater than the distance between opposing shoulder portions whereby said swatch is removably positioned between said opposing discs.

2. A merchandise display rack according to claim 1 in which said shaft is vertical and in which all of said posts are vertical.

3. A merchandise display rack according to claim 2 in which said shaft is supported at only one end.

4. A merchandise display rack according to claim 1 which includes a pair of bearings on each of said discs for rotating said discs about said shaft.

5. A merchandise display rack according to claim 1 in which said shaft passes through the centermost portion of each of said discs.

6. A merchandise display rack according to claim 1 in which each of said discs contain a shoulder on the circumference portion and in which the shoulder on opposing discs face each other.

7. A merchandise display rack according to claim 1 in which said shaft is independently supported at each end.

8. A system of merchandise display racks for displaying the front side of a swatch of flexible material comprising:

a shaft, a plurality of stacked assemblies independently rotatable about said shaft, each of said assemblies comprising a pair of spaced-apart discs each rotatably positioned on said shaft, a shoulder portion located on the periphery of each pair of spaced-apart discs positioned to face each other, a plurality of posts equally spaced between said discs, each of said posts having end portions fixedly attached to corresponding portions near the periphery of said discs whereby each of said assemblies are independently rotatable about said shaft, and a swatch of flexible material having end portions folded about at least one of said posts and inserted towards said shaft for displaying the front side of the swatch, said swatch having a width that is less than the distance between said spaced-apart discs but greater than the distance between opposing shoulder portions whereby said swatches are removably positioned between said opposing discs.

9. A system according to claim 8 in which said shaft and all of said posts are vertical.

10. A system according to claim 9 in which said shaft is supported at only one end.

11. A system according to claim 9 which includes a pair of bearings on each of said discs for rotating said discs about said shaft.

12. A system according to claim 8 in which each rotatable assembly is independently supported on said shaft.

13. A merchandise display rack for displaying the front side of a swatch of flexible material comprising:

a plurality of spaced-apart shafts, a plurality of stacked assemblies independently rotatable about each of said shafts, each of said assemblies comprising a pair of spaced-apart discs each rotatably positioned on a shaft, a shoulder portion located on the periphery of each spaced-apart discs positioned to face each other, a plurality of posts equally spaced between said discs, each of said posts having end portions fixedly attached to corresponding portions near the periphery of said discs whereby each of said assemblies is independently rotatable about a shaft, and a swatch of flexible material having end portions folded about at least one of said posts and inserted towards said shaft for displaying the front side of the swatch, said swatch having a width that is less than the distance between said spaced-apart discs but greater than the distance between opposing shoulder portions whereby said swatches are removably positioned between said opposing discs.

14. A system according to claim 13 in which all of said spaced-apart shafts are vertical and independently supported at each end.

* * * * *